United States Patent [19]

Snow

[11] 4,180,868

[45] Jan. 1, 1980

[54] ALL-WEATHER HAT ACCESSORY

[76] Inventor: Charles C. Snow, 4312 S. 4000 West, Granger, Utah 84120

[21] Appl. No.: 851,785

[22] Filed: Nov. 15, 1977

[51] Int. Cl.[2] ..... A41B 3/16; A42B 1/18

[52] U.S. Cl. ..... 2/203; 2/205; 2/7; 2/172; 2/208

[58] Field of Search ..... 2/415, 422, 171.2, 203, 2/205, 181, 181.2, 181.4, 181.6, 181.8, 207, 171, 10, 202, 204, 185 R, 129, 127, 172, 171.3, 7, 5, 84; 150/2.2, 2.1, 2.3, 2.4

[56] References Cited

U.S. PATENT DOCUMENTS

| | | | |
|---|---|---|---|
| 390,928 | 10/1888 | Weldon | 2/172 |
| 1,860,690 | 5/1932 | Rateau | 2/5 |
| 2,025,772 | 12/1935 | Punton | 2/5 |
| 2,184,043 | 12/1939 | Heilstedt | 2/202 X |
| 2,743,454 | 5/1956 | Woodbury | 2/172 |
| 2,769,308 | 11/1956 | Krasno | 2/171 |
| 2,783,474 | 3/1957 | Campagna et al. | 2/181 X |
| 2,832,077 | 4/1958 | McGinnis | 2/171 |
| 2,870,451 | 1/1959 | Brodsky | 2/202 |
| 3,029,438 | 4/1962 | Henschel | 2/7 |
| 3,039,108 | 6/1962 | Lohrenz | 2/415 X |
| 3,046,560 | 7/1962 | De Grazia | 2/5 X |
| 3,055,012 | 9/1962 | Aileo | 2/205 X |
| 3,100,896 | 8/1963 | Khanbegian | 2/5 |
| 3,205,508 | 9/1965 | Cox | 2/205 X |
| 3,429,138 | 2/1969 | Goldmenstein | 2/7 |
| 3,548,415 | 12/1970 | Waters | 2/171.3 |
| 3,685,055 | 8/1972 | Militello | 2/181.4 |
| 3,768,100 | 10/1973 | Colman et al. | 2/206 X |
| 3,825,952 | 7/1974 | Pershing et al. | 2/205 X |
| 3,906,548 | 9/1975 | Kallis | 2/181.4 |
| 4,017,906 | 4/1977 | Bochynsky et al. | 2/205 X |
| 4,032,991 | 7/1977 | Vandeweghe | 2/206 |
| 4,042,976 | 8/1977 | Reynolds | 2/203 X |

*Primary Examiner*—Werner H. Schroeder
*Assistant Examiner*—Andrew M. Falik
*Attorney, Agent, or Firm*—Trask & Britt

[57] ABSTRACT

An outer material layer is sized in length to extend from above the rim of a hat to below the collar area of a user and sized in width to extend around the rim of the hat rearward between about the temples of the user. An inner material layer is secured to the outer layer about the edges thereof and in between the upper edges and lower edges of the outer layer to form a pocket. A first insert is made of a pliable liquid absorbent material and is sized to fit within the pocket. An elastic band is adapted to the upper edge of the outer layer to tensionally hold the accessory to the hat. A face piece is similarly constructed and extends in length from the bridge of the nose to the upper chest area of the user and in width between about the ears of the user. The face piece also has an elastic band to hold it about the head of the user. In cold weather the inserts act as an insulator along with the outer layer to protect the user against the elements. In warm or hot weather the inserts may be soaked in a liquid such as water to provide evaporative cooling.

16 Claims, 5 Drawing Figures

ALL-WEATHER HAT ACCESSORY

BACKGROUND OF THE INVENTION

1. Field

This invention relates to apparel and more particularly to hats. Specifically, it provides an all-weather accessory for use with hats.

2. State of the Art

In many industrial environments, workers are required to wear protective hats, such as hard hats, during all types of weather conditions. In the winter, such hats typically do not provide adequate warmth or protection from the weather elements for the user. During warm periods, such hats may not provide adequate protection from the sun and may not provide for adequate cooling in and about the vicinity of the head of the wearer. Also, many industrial environments suffer blowing dust, dirt and the like. It would be desirable to protect oneself from such. However, if the weather is warm, such protection may be markedly uncomfortable because it would restrict ventilation and cause the wearer to suffer increased heat.

Various and sundry devices have been devised in the past to provide means or methods for cooling. For example. U.S. Pat. No. 3,070,803 (Slepicka) provides a hat or head apparel device with a water cooling system built therein. Other devices are known which are intended to provide a cooling environment for the user including: U.S. Pat. No. 2,832,077 (McGinnis); 2,875,447 (Goldmerstein); and 594,209 (Mears). Other patents which are related to the comfort of the wearer in a heat environment include U.S. Pat. Nos. 1,633,586 (Hunter) and 3,466,664 (Militello).

Each of these devices fail to provide adequate means to improve shade protection for the wearer during use or means to provide protection from the cold or wind weather elements during use. Other devices or head gear must be obtained by the user to provide protection against such forms of weather. An all-weather hat accessory would be desirable to minimize the cost to the user and to provide more comfort for the user during the varying seasons and weather elements encountered especially in industrial environments.

SUMMARY OF THE INVENTION

A hat accessory includes an outer material layer sized in length to extend from above the rim of a hat to below the collar area of a user. The outer material layer is sized in width to extend around the rim of said hat rearward between about the temples of the user. First securing means is adapted to the outer layer to removably attach said hat accessory to a hat. An inner material layer is secured to the outer layer along the edges of the outer layer and to the outer layer between the upper and lower edges thereof to form a pocket. The pocket is sized in length from about the upper edge of said outer layer to about the collar area of the user when said accessory is attached to the hat. The pocket is sized in width about the width of the outer layer. An insert is sized in length and width about the length and width of the pocket to fit therewithin. The insert is formed of a pliable liquid absorbent material.

The accessory preferably includes second securing means adapted to the outer layer between the opposite longitudinal edges thereof to secure the accessory under the chin of the user.

Preferably the first securing means is an elastic-like band adapted to the upper edge of the accessory. It may be sized in length and to tensionally surround the hat at about the rim thereof. The second securing means is preferably comprised of a cloth strap sized to extend under the chin of the user. It may have attachment means to attach the strap to the other longitudinal edge of the accessory. The attachment means is most preferably a velcro strip secured to the strap with a velcro patch secured to the other longitudinal edge.

In a preferred embodiment, the inner material layer is a gauze-like material and the insert is a foam rubber-like material. The outer material layer is preferably made of a cloth-like fire retardent material. It may also be made of a water repellent material. The hat may be a conventional hard hat.

In a highly preferred embodiment, the accessory includes a face piece comprised of a face piece outer material layer and a face piece inner material layer. The outer material layer and inner material layer and similarly constructed as that of the outer material layer and inner material layer of the accessory. The face piece includes a face piece insert placed in a pocket which extends from about the bridge of the nose of the user to the throat area of the user. The face piece outer layer extends downward into the upper chest area of the user. The face piece has attachment means to attach it to the user. Preferably, the attachment means is an elastic band attached to the outer longitudinal edges of the face piece along the upper edge thereof.

BRIEF DESCRIPTION OF THE DRAWINGS

In the drawings, which illustrate what is presently regarded as the best mode for practicing the invention.

DESCRIPTION OF THE ILLUSTRATED EMBODIMENT

Figure 4:
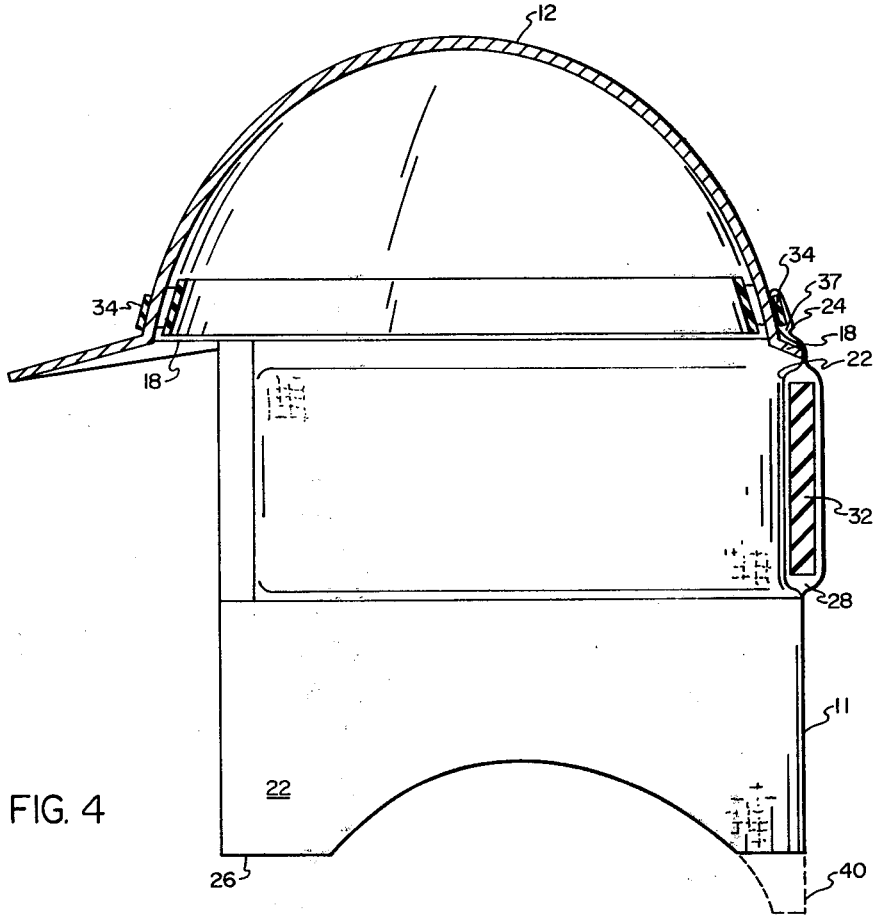
FIG. 4 is a side sectional view of the rear piece of the hat accessory of FIG. 2 adapted to a hat.
Figure 1:
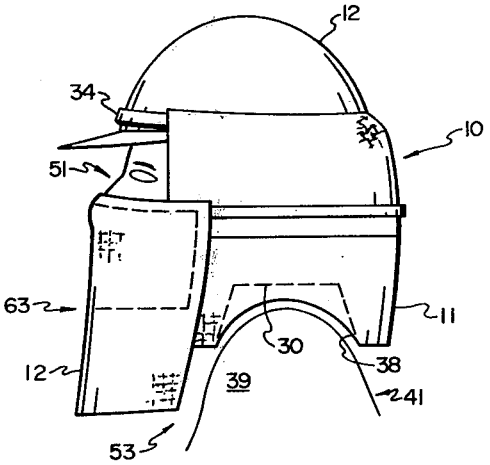
FIG. 1 is a side view of a user with a hat accessory of the instant invention.

FIG. 1 shows a hat accessory generally designated 10 adapted to that which is here shown as a conventional hard hat 12. The hat accessory 10 includes a rear piece 11 and a face piece 12. The rear piece 11 is better shown in FIG. 2. It includes an outer material layer 14 which is sized in length 16 to extend from above the rim 18 (FIG. 4) of the hat 12. The outer layer 14 is sized in width 20 to extend around the rim 18 of the hat 12 rearward between about the temples of the user as best shown in FIG. 1. The outer layer 14 is preferably constructed or formed from a cloth-like material which may be water repellent. When water repellent, the accessory can act to protect the neck or back of the head area of the user from rain or other discomforts associated with inclement weather. The outer layer 14 may also be made of a fire retardent material. Many industrial uses expose the user to fire hazards so that fire retardent clothing is highly preferred. The material may also be lightly colored to reflect light and in turn minimize heat absorption which may otherwise be associated with darker colored materials.

The accessory also has an inner layer 22. It is secured to the outer layer 14 along the edges thereof. It is also secured to the outer layer 14 between the upper 24 and lower 26 edges thereof to form a pocket 28 (FIG. 4) sized in length from about the upper edge 24 of the outer layer 14 to about the collar area 30 (FIG. 1) of a user when the accessory 10 is adapted to the hat 12. The pocket 28 is sized in width about the width 20 of the outer layer 14. The inner layer 22 is preferably made of a mesh-like cloth. The mesh-like cloth is preferably soft to avoid chaffing and/or other discomforts typically experienced in contact with the skin of the user. The mesh also is absorbent to absorb perspiration during periods of hot weather or heavy exertion.

An insert 32 is positioned within the pocket 28. The insert 32 is sized to about the length and width of the pocket to fit therewithin. The insert 32 is preferably formed of a pliable liquid-absorbent material so that in periods of warm weather it may be soaked in a liquid, such as water. Upon positioning about the head of a user, the heat will cause the water to evaporate and in turn provide evaporative cooling about the neck area of the user. The insert 32 is preferably a foam rubber-like substance or sponge-like substance. When the accessory 10 is soaked in water, the insert 32 absorbs the liquids, such as water, which in turn evaporates because of the significant air contact provided by virtue of the use of the mesh-like inner layer 22.

The accessory 10 may be adapted to the hat 12 by a variety of means. Preferably, an elastic-like band 34 is provided. It may be stitched entirely within a pocket along the upper edge 24 of the outer layer. The band 34 is sized to surround the hat 12 and tensionally hold the accessory 10 thereto above the rim 18 of the hat. The band may be secured to the upper corners 35*a* and 35*b* of the rear piece 11. However, it is preferably circumferential and positioned within a small pocket 37 formed along the upper edge 24 of the rear piece 11.

The lower edge 26 of the inner and outer layers 14 and 22, respectively, may be sculptured or tailored to form a notch 38 sized so that the accessory 10 fits over the shoulders 39 of the user without bunching or providing a mass of material not readily placeable in and about the neck area 30 of the user. The lower edge 26 may also have a tail 40 which extends downward into the upper back area 41 of the user so that the user may place a coat or other apparel over the accessory 10 to hold it in place and to provide a reasonably and substantially air-tight or weather-tight fit if desired. Maximum protection against the elements such as wind, rain, snow and other discomforting weather elements including blowing sand, dust and dirt can thus be obtained.

Figure 5:
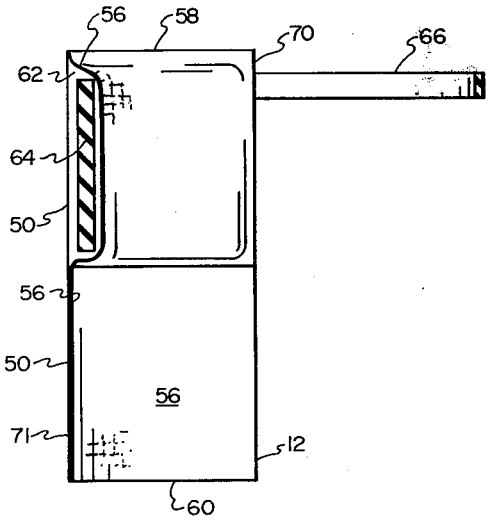
FIG. 5 is a sectional view of the face piece of the hat accessory of the instant invention of FIG. 3 along the section lines 5—5.
Figure 3:
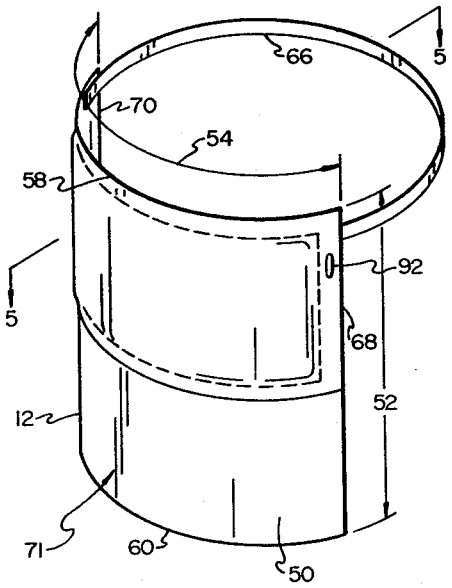
FIG. 3 is a perspective view of a face piece of the hat accessory of the instant invention.

The accessory 10 may also include a face piece 12 as hereinbefore stated. Referring now to FIG. 3, a face piece is shown being comprised of an outer layer 5 sized in length 52 from approximately the bridge of the nose 51 of the user to the upper chest area 53 (FIG. 1) of the user. It is sized in width 54 to extend frontward approximately between the ears of the user over the face of the user. The inner layer 56 is sized to the outer layer and secured to the outer edges thereof. It is also secured to the outer layer 50 between the upper edge 58 and lower edge 60 of the outer layer 50 to form a pocket 62 (FIG. 5) sized in length to extend from the bridge of the nose of the user to approximately the throat area 63 of the user and in width to extend about the width of the outer layer 50. An insert 64 is positioned within the pocket 62. The insert 64 is fabricated of material similar or identical to the material used for the insert 32 of the rear piece 11. The insert 64 is sized in width and in length to that of the pocket 62 to fit therewithin. Attachment means, which as illustrated in FIG. 3, is an elastic band 66, is adapted to the outer longitudinal edges 68 and 70 of the outer layer 50. The elastic band 66 is sized to surround the rear piece 11 about the level of the bridge of the nose 51 of the user to tensionally hold the face piece 12 over the bridge of the nose of the user. The outer layer 50 of the face piece 12 may be made of material similar to and preferably identical to the outer layer 14 of the accessory 10. The inner layer 56 of the face piece 12 is preferably formed of a similar mesh-like material as the inner layer 22 of the accessory 10 and preferably of identical material. The face piece 12 may be regarded as having a bib portion 71 which can be secured under a coat or other apparel comparable to an ascot or scarf to provide protection against weather elements similar to that provided by the rear piece 11.

The rear piece 11 may also include means to secure it under the chin of the user. Such means may include straps, buttons, strings or other devices. However, preferably, such means is comprised of a cloth strap 80 (FIG. 2) adapted to one longitudinal edge 81 of the outer layer 14. A velcro strip 82 is attached thereto. A matching velcro path 84 is affixed to the other edge 85 of the outer layer 14. Accordingly, the strap 80 may be pulled under the chin and affixed by the matching velcro strips 84 and 82.

Figure 2:
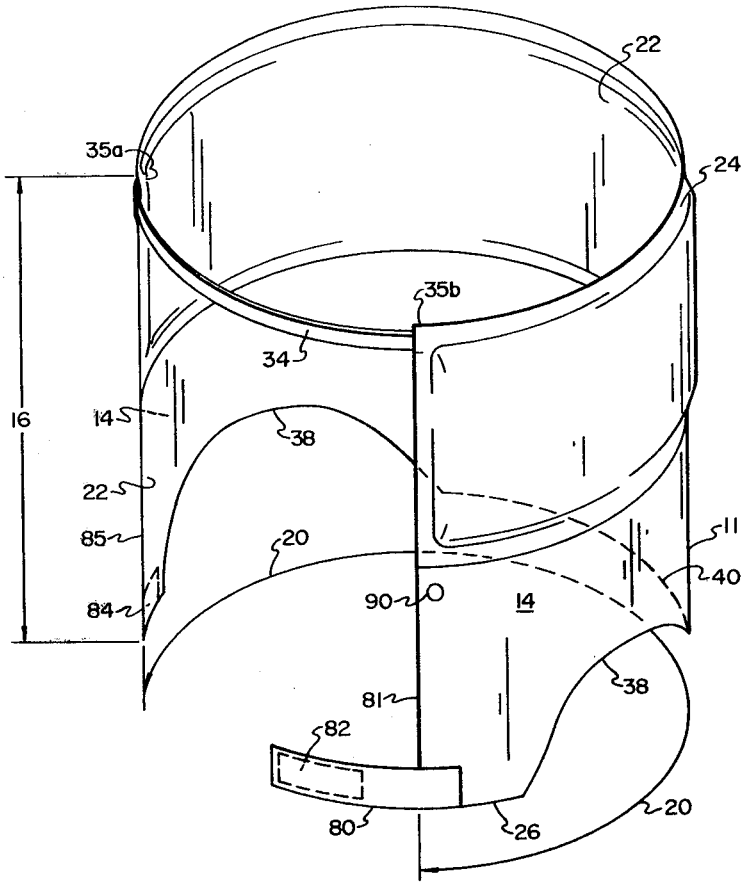
FIG. 2 is a perspective view of the rear piece of a hat accessory of the instant invention.

The face piece 12 may additionally be secured to the accessory 10 by providing a button 90 and a matching buttonhole 92, as shown in FIGS. 2 and 3. A matching button 90 and 92 may also be provided along the other longitudinal edges 85 and 70 of the rear piece 11 and face piece 12 in lieu of the elastic band 66 to constitute attachment means.

In use, the rear piece 11 may be used separately or together with the face piece 11. If the weather is hot, the rear piece can be soaked in cool water and positioned on the hat 12 about the head of the user. The heat will cause the water to evaporate and cool the user's neck and head area. The structure of the rear piece will keep the sun off the user's neck and also act to keep blowing things (dirt, dust, etc.) away from the user's head. In cool or cold circumstances, the rear piece 11 acts to protect from cold, snow, sleet and the like and to retain body heat. The face piece 12 affords use similar to the rear piece 11.

It may be noted that the hat 12 herein illustrated is a conventional hard hat frequently used in industrial environments. The instant invention may also be used with other conventional hats.

It is to be understood that the embodiments of the invention described herein are merely illustrative of the application of the principals of the invention. Reference herein to details of the illustrated embodiment is not intended to limit the scope of the claims which themselves set forth those features regarded as essential to the invention.

I claim:

1. A hat accessory comprising:

an outer material layer sized in length to extend from above the rim of a hat to below the collar area of a user and sized in width to extend around the rim of said hat rearward between about the temples of the user;

first securing means adapted to said outer layer to removably attach said hat accessory to a hat, said first securing means being an elastic-like band adapted to the upper edge of said accessory and being sized in length to tensionally surround said hat at about the rim thereof;

an inner material layer secured to said outer layer along the edges of said outer layer and to said outer layer between the upper and lower edges thereof to form a pocket sized in length from about the upper edge of said outer layer to about the collar area of a user when said accessory is attached to said hat and in width about the width of said outer layer;

an insert sized in length and width about the length and width of said pocket to fit therewithin, said insert being formed of a pliable liquid absorbent material; and a face piece comprising:

a face piece outer material layer sized in length to extend from about the bridge of the nose of the user to the upper chest area of the user and in width to extend frontward about the face of the user between about the ears of the user, third securing means adapted to said face piece outer layer to removably hold said face piece over the face of said user, a face piece inner material layer secured to said face piece outer layer along the edges of said face piece outer layer and to said face piece outer layer between the upper and lower edges thereof to form a second pocket sized in length from about the upper edge of said face piece to about the throat area of the user and in width about the width of said face piece, and a face piece insert sized in length and width about the length and width of said second pocket to fit therewithin, said insert being formed of a pliable liquid absorbent material.

2. The accessory of claim 1 further comprising second securing means adapted to said outer layer between opposite longitudinal edges thereof to secure said accessory under the chin of the user.

3. The accessory of claim 1 wherein said face piece inner material layer is a gauze-like material, said face piece insert is a foam rubber-like material and wherein said third securing means is an elastic-like band adapted to the upper edge of said face piece and which is sized in length to tensionally surround said accessory.

4. The accessory of claim 2 wherein said second securing means is comprised of a cloth strap sized to extend under the chin of a user which is secured to and extends from a first longitudinal edge of said accessory and which has removable attachment means to attach said strap to the other longitudinal edge of said accessory.

5. The accessory of claim 4 wherein said attachment means is a velcro strip secured to said strap and a velcro patch secured to said other longitudinal edge.

6. The accessory of claim 4 wherein said inner material layer is a gauze-like material and wherein said insert is a foam rubber-like material.

7. The accessory of claim 6 wherein said outer material layer is made of a cloth-like fire retardant material.

8. The accessory of claim 6 wherein said outer material is made of a cloth-like water repellent material.

9. The accessory of claim 6 wherein said hat is a conventional hard hat.

10. In combination, a hat and an all weather accessory therefor comprised of:

an outer material layer sized in length to extend from above the rim of a hat to below the collar area of a user and sized in width to extend around the rim of said hat rearward between about the temples of the user;

first securing means adapted to said outer layer to removably attach said hat accessory to a hat, said first securing means being an elastic-like band adapted to the upper edge of said accessory and being sized in length to tensionally surround said hat about the rim thereof;

an inner material layer secured to said outer layer along the edges of said outer layer and to said outer layer between the upper and lower edges thereof to form a pocket sized in length from about the upper edge of said outer layer to about the collar area of a user when said accessory is attached to said hat and in width about the width of said outer layer;

an insert sized in length and width about the length and width of said pocket to fit therewithin, said insert being formed of a pliable liquid absorbent material; and a face piece comprising:

a face piece outer material layer sized in length to extend from about the bridges of the nose of the user to extend frontward about the face of the user between about the ears of the user, third securing means adapted to said face piece outer layer to removably hold said face piece over the face of said user, a face piece inner material layer secured to said face piece outer layer along the edges of said face piece outer layer and to said face piece outer layer between the upper and lower edges thereof to form a second pocket sized in length from about the upper edge of said face piece to about the throat area of the user and in width about the width of said face piece, and a face piece insert sized in length and width about the length and width of said second pocket to fit therewithin, said insert being formed of a pliable liquid absorbent material.

11. The combination of claim 10 further comprising second securing means adapted to said outer layer between opposite longitudinal edges thereof to secure said accessory under the chin of the user.

12. The combination of claim 11 wherein said second securing means is comprised of a cloth strap sized to extend under the chin of a user which is secured to and extends from a first longitudinal edge of said accessory and which has removable attachment means to attach said strap to the other longitudinal edge of said accessory.

13. The combination of claim 12 wherein said attachment means is a velcro strip secured to said strap and a velcro patch secured to said other longitudinal edge and wherein said inner material layer is a gauze-like material and wherein said insert is a foam rubber-like material.

14. The combination of claim 10 wherein said outer material layer is made of a cloth-like fire retardant material.

15. The combination of claim 10 wherein said outer material is made of a cloth-like water repellent material.

16. The combination of claim 10 wherein said face piece inner material layer is a gauze-like material, said face piece insert is a foam rubber-like material and wherein said third securing means is an elastic-like band adapted to the upper edge of said face piece and which is sized in length to tensionally surround said accessory.

* * * * *